United States Patent [19]

Flinn et al.

[11] Patent Number: 4,768,577

[45] Date of Patent: Sep. 6, 1988

[54] DISSOLUTION OF INERT GAS IN A METAL ALLOY

[75] Inventors: John E. Flinn, Idaho Falls; Gary E. Korth, Blackfoot; Richard N. Wright, Idaho Falls; Denis E. Clark, Idaho Falls; Richard B. Loop, Idaho Falls, all of Id.

[73] Assignee: The United States of America as represented by the Department of Energy, Washington, D.C.

[21] Appl. No.: 916,143

[22] Filed: Oct. 7, 1986

[51] Int. Cl.[4] ..... B22D 23/00

[52] U.S. Cl. ..... 164/66.1; 164/46; 264/5; 264/12; 75/0.5 C

[58] Field of Search ..... 164/66.1, 67.1, 46, 164/259, 415, 423, 463, 475; 264/5, 12; 75/0.5 BA, 0.5 B, 0.5 C

[56] References Cited

U.S. PATENT DOCUMENTS

| | | | |
|---|---|---|---|
| 3,988,084 | 10/1976 | Esposito et al. | 264/12 |
| 4,066,117 | 1/1978 | Clark et al. | 164/66.1 |
| 4,069,045 | 1/1978 | Lundgren | 75/0.5 C |
| 4,233,062 | 11/1980 | Siddall | 75/0.5 C |
| 4,240,831 | 12/1980 | Ro et al. | 75/0.5 C |
| 4,610,719 | 9/1986 | Wentzell | 264/12 |
| 4,650,130 | 3/1987 | Hathaway et al. | 164/423 |

*Primary Examiner*—Nicholas P. Godici
*Assistant Examiner*—Richard K. Seidel
*Attorney, Agent, or Firm*—Robert P. Cogan

[57] ABSTRACT

A metal powder is produced by inert gas atomization processes. The atomization process is regulated to provide a preselected level of inert gas alloyed in the metal.

18 Claims, 1 Drawing Sheet

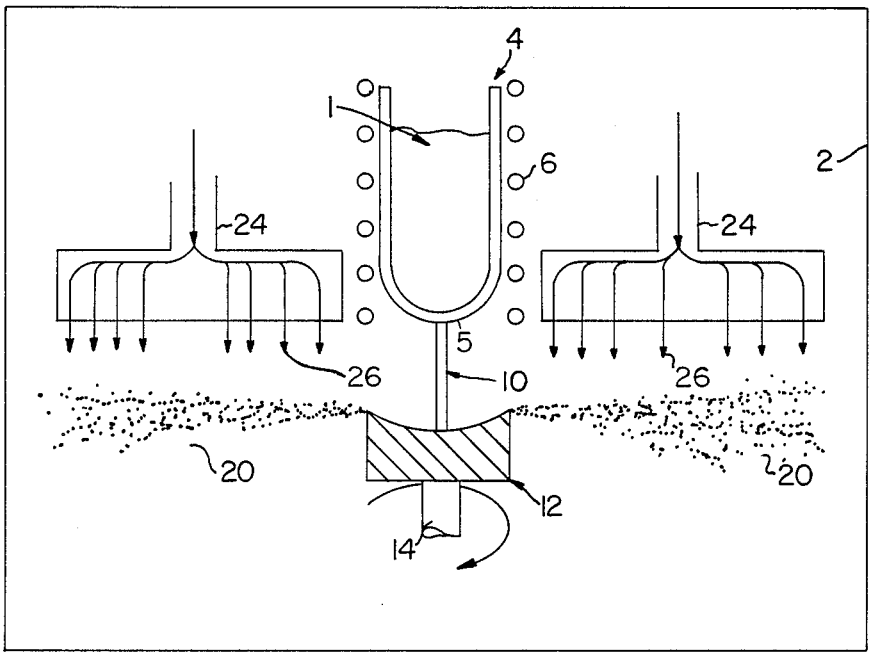
4
1
6
2
24
24
5
26
10
26
20
20
12
14

DISSOLUTION OF INERT GAS IN A METAL ALLOY

CONTRACTUAL ORIGIN OF THE INVENTION

The U.S. Government has rights in this invention pursuant to Contract Number DE-AC07-76ID05170 between the U.S. Department of Energy and EG&G Idaho, Inc.

BACKGROUND OF THE INVENTION

This invention relates generally to metal alloys and more particularly to a method of atomizing metal to produce a powder and to a powder produced thereby.

Metal powders are useful in producing shaped metal pieces formed by explosive consolidation for example. One such metal powder is Type 304 stainless steel. A known method for producing metal powder is centrifugal atomization. Metal is forced from a melt to the surface of a rotating cup. Droplets of metal flung from the surface of the cup form atomized metal powder. Quench gas is used to quench the airborne metal powder. The powder can then be collected by such means as a cyclone separator. The atmospheres in which the melt is maintained and in which the powder is quenched will affect characteristics of the metal powder produced. One characteristic is its fineness. Another is the amount of gas entrained therein. Other methods exist for entraining gas in metal.

Utilization of helium, an inert gas, in the melt atmosphere or in the quench gas is known in prior art methods. Helium is known as a quench gas. P.R. Holiday, A.R. Cox, and R.J. Patterson II, "Rapid Solidification Effects on Alloy Structures," *Proc. Int'l Conf. on Rapid Solidification Processing, Nov.* 13–16, 1977, (Claitor's Publishing Division, Baton Rouge, La, 1978). As illustrated in U.S. Pat. No. 4,610,719, it can also be used to pressurize a melt in a process for enhancing fineness of powder. While some degree of entrainment of helium in metal may be inherent in such processes, it is not generally regarded as desirable. H. Ullmaier, "The Influence of Helium on the Bulk Properties of Fusion Reactor Structural Materials," *Nuclear Fusion,* 24, (1984), pp. 1029–1083, discusses helium embrittlement of Type 304 stainless steel.

In accordance with the present invention, however, helium, and/or other gas, is combined in a predetermined manner to provide metals with improved properties by new methods.

SUMMARY OF THE INVENTION

It is, therefore, a general object of the present invention to provide a method for alloying inert gases in metal. It is a more particular object of the present invention in one form to provide a method for producing a preselected level of helium in Type 304 stainless steel.

It is also a general object of the present invention to provide a method for making atomized metal powders with beneficial levels of entrained inert gas.

It is another general object of the present invention to provide a method for making metals with beneficial levels of entrained inert gas.

It is a further object of the present invention to provide metals and metal powders containing preselected levels of inert gas.

Briefly stated, in accordance with the present invention, there are provided a method and metal powder produced thereby in which beneficial levels of entrained gas are introduced in metal. In the preferred form, metal is atomized and quenched in a helium quench gas. Concentration of helium in metal produced thereby is measured. Parameters of the atomization process are regulated to provide for a desired concentration of helium in the metal.

BRIEF DESCRIPTION OF THE DRAWINGS

The method and means by which the foregoing features of invention are achieved are pointed out with particularity in the claims forming the concluding portion of the specification. The invention, both as to its organization and manner of operation may be further understood by reference to the following description taken in connection with the following drawings.

Of the drawings:

The Figure is a mechanical schematic illustration of means for centrifugal atomization.

DESCRIPTION OF THE PREFERRED EMBODIMENTS

Referring to the Figure, there is illustrated in schematic form a system for producing atomized metal powder. A melt 1 of metal to be atomized is centered within a chamber 2 and provided in a crucible 4 having an outlet 5 and heated by a heating coil 6. From the outlet 5, a melt stream 10 is delivered to a rotating cup 12 on drive means 14. The centrifugal force applied to the melt stream 10 by the cup 12 contributes to production of atomized powder 20. Gas delivery means comprising a manifold 24 provide a stream of quench gas 26 for rapidly cooling the atomized powder 20. The characteristics of the atomizing process comprise pressure, temperature and composition of the pressurizing gas within the crucible 4, ambient temperature surrounding the melt stream 10 and the rotating cup 12, temperature, flow rate and composition of the quench gas 26 and speed of the drive means 14.

To produce metal powders in accordance with the present invention, a melt was atomized. The resulting powders were then analyzed for inert gas content, and the atomization characteristics were regulated to provide for the preselected level of inert gas in the metal powder.

EXAMPLE I

A melt 1 of Type 304 stainless steel was provided. It was melted in the crucible 4 and temperature was maintained between 50 degrees to 100 degrees C. above the melting point. The melt was forced sufficiently to overcome surface tension and provide a steady stream 10 to the rotating cup 12 which projected a stream of atomized powder several meters.

The manifold 24 was toroidal and provided a downward stream of scrubbed helium from a supply at an ambient temperature. The ambient temperature was a nominal room temperature and is not critical. Flow was adjusted to provide a cooling rate of about 1000 degrees C. per second.

A concentration of 8–10 atomic parts per million helium was retained in the atomized metal powder. This was a desired level.

EXAMPLE II

Metal powder was produced by ultrasonic gas atomization of Type 304 stainless steel using argon gas, which yielded a metal having beneficially affected properties. High velocity gas jets replaced the rotating cup 12 and manifold 24.

The restriction of grain growth and retention of small grain sizes for alloys to be derived from powders atomized in the presence of helium or argon gas appears to be independent of alloy chemistry and structure as well as the method used for consolidation of the powders. The retention of small grain size is attributed to the presence of helium or other inert gases in beneficial amounts. The resistance to grain growth provides a high temperature microstructural stability that is very beneficial to metals and metal alloys. Other beneficial effects include higher strength, higher strength persisting at higher temperature service, and creep resistance without loss of ductility.

The mechanism for introducing helium or other inert gases in the metal structure is not fully understood. At the present time, regulating the amount of gas in the metal could comprise producing metal, measuring gas level, and adjusting the parameters of the atomizing process to determine empirically which adjustments will vary the gas level.

"Beneficial level" of gas can be determined by measuring resistance to grain growth. It is known that a level of 2–20 atomic parts per million of inert gas in metal has shown beneficial effects, and a range of 8–10 atomic parts per million appears to be preferred. A non-beneficial level, e.g. greater than 100 atomic parts per million, can be discerned by the presence of undesired properties. One undesired property is increased embrittlement in response to neutron radiation.

Effects of a particular gas concentration can be ascertained by comparison of characteristics of the gas alloy to characteristics of the metal without a given level of gas entrained therein. "Benefits" generally represent an optimization of selected parameters. For example, a "trade-off" between strength and ductility must be made in certain applications. "Beneficiality" may often be measured with respect to ultimate applications of the metal.

What is claimed as new and desired to be secured by Letters Patent of the United States is:

1. A method of making a metal power comprising the steps of:

providing a metal melt;

atomizing said metal produce metal powder with inert gas entrained therein; and regulating the step of atomizing with respect concentration of said inert gas to introduce a beneficial level comprising a prepselected level of atomic parts per million thereof entrained in said metal.

2. The method of claim 1 wherein the step of providing a metal belt comprises providing Type 304 stainless steel.

3. The method of claim 1 wherein the step of atomizing said metal in inert gas comprises providing helium quench gas.

4. The method of claim 3 wherein the step of providing helium quench gas comprises providing a flow of helium for cooling said powder at the rate of approximately 1000 degrees C per second.

5. The method of claim 3 wherein the step of regulating comprises introducing a level of 5–20 atomic parts per million inert gas.

6. The method of claim 5 wherein the step of regulating comprises introducing a level of 8–10 atomic parts per million of inert gas.

7. The method of claim 1 wherein the step of atomizing comprises providing an argon quench gas.

8. The method of claim 7 wherein the step of regulating comprises introducing a level of 5–20 atomic parts per million inert gas.

9. The method of claim 8 wherein the step of regulating comprises introducing a level of 8–10 atomic parts per million of inert gas.

10. A method of making a metal powder comprising the steps of:

providing a metal melt;

providing an inert gas atmosphere;

performing the steps of producing a powder from said melt in said atmosphere to provide a level of inert gas entrained in said metal powder; and setting parameters of said powder forming steps with respect to concentration of said inert gas produced thereby to introduce a beneficial level of inert gas in said metal power within a desired range of concentration in atomic parts per million.

11. The method of claim 10 wherein the step of providing said inert gas comprises providing an atmosphere comprising helium.

12. The method of claim 11 wherein the step of providing a metal melt comprises providing type 304 stainless steel.

13. The method of claim 11 wherein the step of setting parameters comprises introducing a level of 5–20 atomic parts per million inert gas.

14. The method of claim 11 wherein the step of setting parameters comprises introducing a level of 8–10 atomic parts per million of inert gas.

15. The method of claim 10 wherein the step of providing a metal melt comprises providing time 304 stainless steel.

16. The method of claim 10 wherein the step of providing said inert gas comprises providing an atmosphere comprising argon.

17. The method of claim 16 wherein the step of setting parameters comprises introducing a level of 5-20 atomic parts per million inert gas.

18. The method of claim 16 wherein the step of setting parameters comprises introducing a level of 8-10 atomic parts per million of inert gas.

* * * * *